US012808195B2

(12) United States Patent
Cislo

(10) Patent No.: US 12,808,195 B2
(45) Date of Patent: Nov. 24, 2026

(54) APPARATUS FOR MINIMIZING WIND UPLIFT EFFECTS UPON A ROOFING OR DECKING SYSTEM

(71) Applicant: Jacob Thomas Cislo, Orchard Park, NY (US)

(72) Inventor: Jacob Thomas Cislo, Orchard Park, NY (US)

( * ) Notice: Subject to any disclaimer, the term of this patent is extended or adjusted under 35 U.S.C. 154(b) by 208 days.

(21) Appl. No.: 18/736,734

(22) Filed: Jun. 7, 2024

(65) Prior Publication Data

US 2024/0410177 A1 Dec. 12, 2024

Related U.S. Application Data

(60) Provisional application No. 63/471,617, filed on Jun. 7, 2023.

(51) Int. Cl.
*E04D 13/12* (2006.01)

(52) U.S. Cl.
CPC ..... *E04D 13/12* (2013.01)

(58) Field of Classification Search
CPC ..... E04D 13/12; E04D 11/005
See application file for complete search history.

(56) References Cited

U.S. PATENT DOCUMENTS 3,861,098 A * 1/1975 Schaub ..... E04D 11/005 52/263
5,363,614 A * 11/1994 Faulkner ..... E04D 11/005 52/480
6,702,515 B1 * 3/2004 Frederiksen ..... E04D 11/005 52/509
6,851,236 B1 * 2/2005 Harvey ..... B26F 3/12 404/34
8,336,278 B2 * 12/2012 Smith ..... E01C 5/223 52/603
9,982,439 B2 * 5/2018 Essig ..... E04F 15/02405
10,422,139 B1 * 9/2019 Warmerdam ..... E04D 11/005
10,633,866 B2 * 4/2020 Brenchley ..... E04D 13/0481
10,731,350 B1 * 8/2020 Yang ..... E04F 15/02183
10,787,815 B2 * 9/2020 Jang ..... E04D 13/1681
10,883,268 B2 * 1/2021 Jang ..... E04D 11/00
11,131,094 B1 * 9/2021 Robinson ..... E04D 13/12
11,261,609 B2 * 3/2022 Pommier ..... E04F 15/024
11,603,665 B2 * 3/2023 Jang ..... E04D 13/172
(Continued)

*Primary Examiner* — Rodney Mintz
(74) *Attorney, Agent, or Firm* — Barclay Damon LLP

(57) ABSTRACT

A roofing or decking system having a plurality of paver bricks and a platform onto which the paver bricks are disposed in side by side relation further includes a plurality of adaptive components, each adaptive component being attached to respective corner portions of the inner facing surfaces of the paver bricks to create an air gap between the paver bricks and the platform that effectively minimizes wind uplift forces. Each adaptive component includes an upper surface and an opposing lower surface, including a two-sided adhesive strip attached to the upper surface with the exception of a corner portion of the upper surface that is recessed. When the roofing or decking system is assembled, the recessed portion provides an additional corner spacing or gap that enables placement of a pedestal between a number of intersecting paver bricks and adjustment features of the pedestal.

10 Claims, 9 Drawing Sheets

(56) References Cited

U.S. PATENT DOCUMENTS

| | | | | |
|---|---|---|---|---|
| 11,781,314 | B2 * | 10/2023 | Fracassi | E04B 2/06 52/223.6 |
| 12,241,251 | B2 * | 3/2025 | Killian | E04D 13/17 |
| 2010/0223880 | A1 * | 9/2010 | Smith | E04F 15/10 52/778 |
| 2010/0275528 | A1 * | 11/2010 | Andrews | E04F 15/02464 52/173.1 |
| 2010/0275531 | A1 * | 11/2010 | Andrews | E04D 11/005 52/173.1 |
| 2017/0260750 | A1 * | 9/2017 | Essig | E04F 15/02183 |
| 2017/0292263 | A1 * | 10/2017 | Brenchley | E04D 13/0481 |
| 2020/0123786 | A1 * | 4/2020 | Pommier | E04F 15/022 |
| 2020/0190808 | A1 * | 6/2020 | Jang | E04D 11/00 |
| 2020/0190809 | A1 * | 6/2020 | Jang | E04D 11/005 |
| 2020/0263434 | A1 * | 8/2020 | Yang | E04D 11/005 |
| 2020/0340189 | A1 * | 10/2020 | DiNorcia | E01C 5/001 |
| 2021/0115689 | A1 * | 4/2021 | Liu | E04H 9/0215 |
| 2021/0381243 | A1 * | 12/2021 | Jang | E04D 13/1662 |
| 2023/0193624 | A1 * | 6/2023 | Fracassi | E04B 2/06 52/223.6 |
| 2024/0068236 | A1 * | 2/2024 | Killian | E04D 13/17 |
| 2026/0071392 | A1 * | 3/2026 | Spitzer | E01C 5/001 |

* cited by examiner

APPARATUS FOR MINIMIZING WIND UPLIFT EFFECTS UPON A ROOFING OR DECKING SYSTEM

CROSS REFERENCE TO RELATED APPLICATION

This application claims priority to U.S. Patent Application Ser. No. 63/471,617, entitled: APPARATUS FOR MINIMIZING WIND UPLIFT EFFECT UPON A ROOFING OR DECKING SYSTEM, filed Jun. 7, 2023, pursuant to relevant portions of 35 U.S.C. § 119 and 35 U.S.C. § 120, the entire contents of this application being incorporated by reference.

TECHNICAL FIELD

This application is generally directed to roofing and decking systems and more specifically to apparatus for reducing/minimizing the effects of wind uplift upon a roofing or decking system.

BACKGROUND

Roofing and decking systems are commonly known in the field. A typical decking system may consist of a plurality of paver bricks disposed on a platform or similar supporting surface, in addition to a number of pedestals disposed on the platform and at respective corners of the paver bricks.

An undesirable issue with these particular systems, as with any system disposed on a roof or similar structure, is that of wind induced uplift forces that are created beneath and above the system, which can create considerable damage.

BRIEF DESCRIPTION

Therefore and according to a first aspect of the present invention, there is disclosed a roofing or decking system comprising a plurality of paver bricks, each of the paver bricks being disposed on a platform or similar supporting surface. The paver bricks each include an outer facing surface and an inner facing surface wherein an adaptive component of the system is attached to respective corners of the paver bricks at the inner facing surfaces thereof. Each adaptive component can include an adhesive strip on an upper surface to enable securement to the paver brick. When attached, the adaptive components create a gap between the paver bricks and the platform designed to permit air to flow therethrough so as to minimize the effect of wind uplift on the roofing or decking system. According to at least one version, the adaptive component is sized and configured to be fitted upon a corner of a paving brick and includes a portion that is recessed in relation to the remainder of the upper surface. This recessed portion enables connectivity to a pedestal or similar component of the roofing or decking system, such as for permitting adjustments as needed.

According to another aspect of the present invention, there is disclosed a method for minimizing uplift created by wind force on a roofing or decking system, the method comprising the steps of providing a plurality of paver bricks, attaching an adaptive component to the corner of each of the paver bricks on an inner facing surface, in which each adaptive component has an adhesive strip attached to an upper surface of the adaptive component that permits attachment to the paver brick with the exception of a recessed portion, and disposing each of the paver bricks on a platform in which the adaptive components create an air gap between the paver bricks and the platform that minimizes the effects of wind uplift.

In at least one preferred version, the paver bricks are arranged such that pedestals can be placed at intersecting corners of intersecting paver bricks, wherein the recessed portion at the upper surface of the adhered adaptive components enables adjustments to be made, as needed, using the pedestals.

According to yet another aspect of the present invention, there is disclosed an adaptive component that minimizes the effects of wind uplift in a roofing or decking system made up of a plurality of paver bricks and a platform on which the plurality of paver bricks are disposed, the adaptive component including an upper surface and an opposing lower surface in which the upper surface includes a recessed corner section and an adhesive strip disposed over substantially the entire upper surface with the exception of the recessed corner section for attachment to an underside of a paver brick at a corner thereof. A plurality of the adaptive components can be attached to respective corners of a plurality of paver bricks in order to create an air gap between the plurality of paver bricks and the platform for minimizing wind uplift effects upon the roofing or decking system.

One advantage realized is that the herein described adaptive components effectively couple a plurality of paver bricks relative to pedestals of the decking or roofing system in which the air gap created between the paver bricks and the platform by the adaptive components effectively minimizes wind created uplift loads.

Another advantage is that the herein described components can be easily, reliably and readily applied to a decking or roofing system easily and without significant cost in terms of time or manufacture and in which modifications are slight.

Other features and advantages will be readily apparent from the following Detailed Description, which should be read in conjunction with the accompanying drawings.

BRIEF DESCRIPTION OF THE DRAWINGS

The accompanying drawings, which are incorporated herein and constitute part of this specification, illustrate presently preferred embodiments of the invention, and together with the general description given above and the detailed description given below, serve to explain features of the invention (in which like reference numerals represent like elements or steps) of which.

DETAILED DESCRIPTION

The following description relates to an adaptive component that can be used in conjunction with paver bricks for a roofing or decking system for the purposes of minimizing the impacts of wind uplift, as well as an exemplary system that includes the adaptive component(s) and a related method for minimizing wind uplift of a roofing or decking system. It will be understood that numerous variations and modifications are possible to a person reading this application. In addition, the drawings provided are intended to show salient features of the invention. In the course of description, several terms are used in order to provide a suitable frame of reference with the accompanying drawings. These terms, which may include "inner", "outer", "above", "beneath", "distal", "proximal", and the like are not intended to be limiting of the invention except where so specifically indicated. In addition, and since the drawings are intended to show aspects of the invention, the drawings should not relied upon for scaling purposes. In addition, dimensions are provided in accordance to a specific embodiment described herein, but it will be understood that the dimensions can be varied, for example, depending on the specific roofing or decking system in which the apparatus is being used.

With reference to FIGS. 1-4, there is shown an inventive apparatus, hereinafter referred to as an adaptive component, made in accordance with an exemplary version or embodiment for purposes of minimizing wind uplift forces in a roofing or decking system. As further discussed herein, a plurality of adaptive components are attachable to a plurality of paver bricks of the system to create a substantial gap between the paver bricks and a platform to minimize wind uplift forces while the adaptive components are further configured, as discussed herein to enable use of pedestals between the disposed paver bricks of the roofing or decking system.

According to this exemplary embodiment, the adaptive component 100 is a substantially planar section having a rectilinear configuration including an upper surface 110 and an opposing lower surface or side 120. The adaptive component 100 according to this preferred version is made from specialty plastics, although other suitable structural materials such as metal can also be used.

Figure 1:
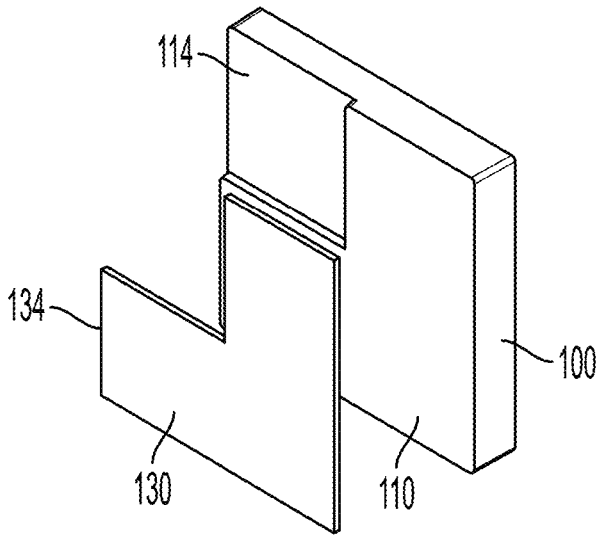
FIG. 1 is a top perspective view of an adaptive component for a roofing or decking system in accordance with aspects of the present invention.
Figure 2:
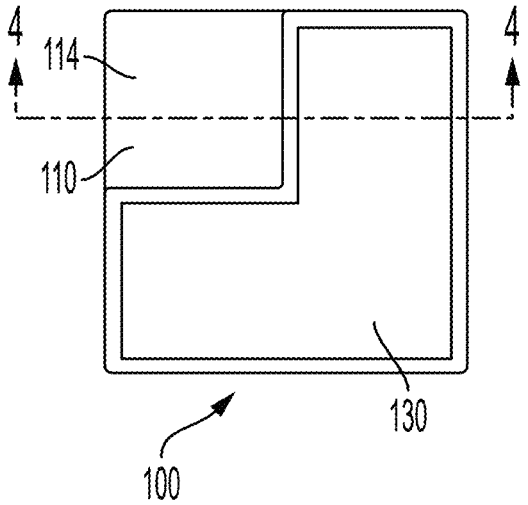
FIG. 2 is a top plan view of the adaptive component of FIG. 1.
Figure 4:
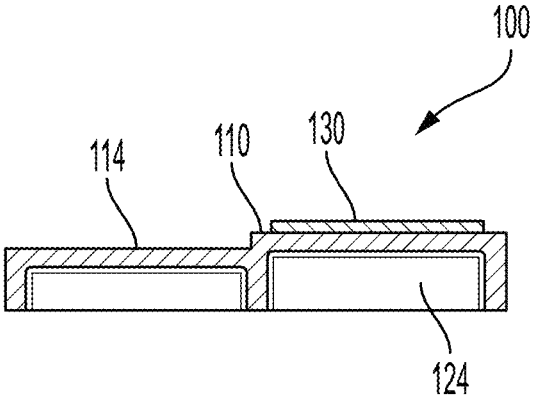
FIG. 4 is a side elevational view of the adaptive component of FIGS. 1-3, taken about Section A-A of FIG. 1
Figure 5A:
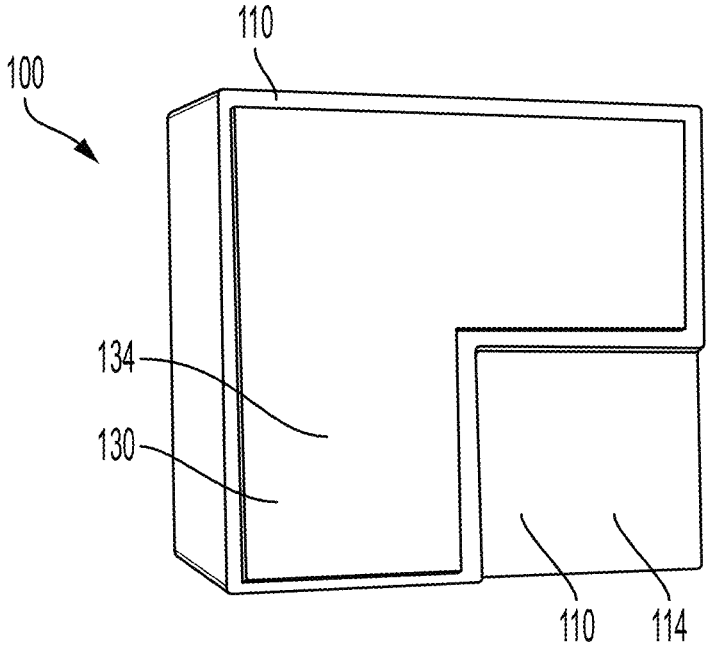
FIGS. 5(*a*)-5(*g*) are sequential views depicting the attachment of the adaptive component of FIGS. 1-4 to a paver brick of a decking or roofing system.
Figure 5B:
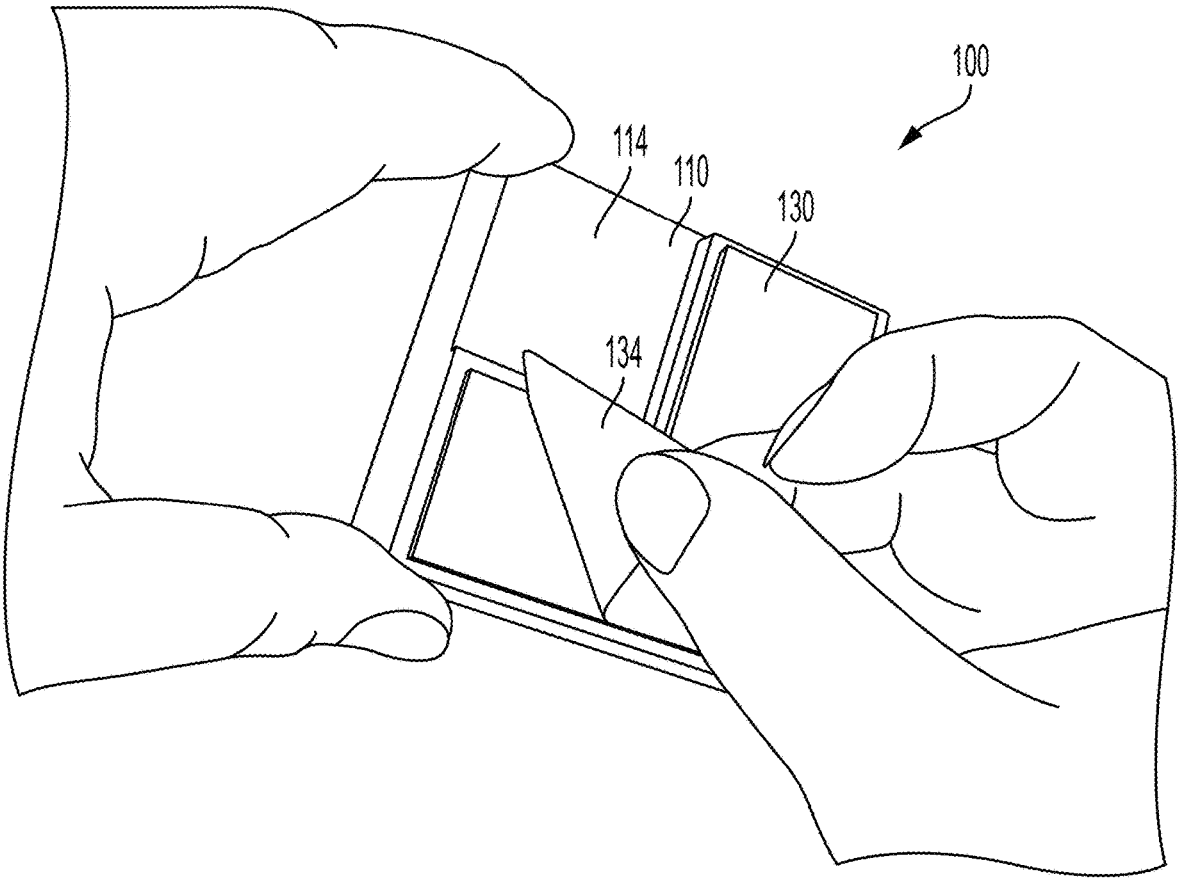
Figure 5C:
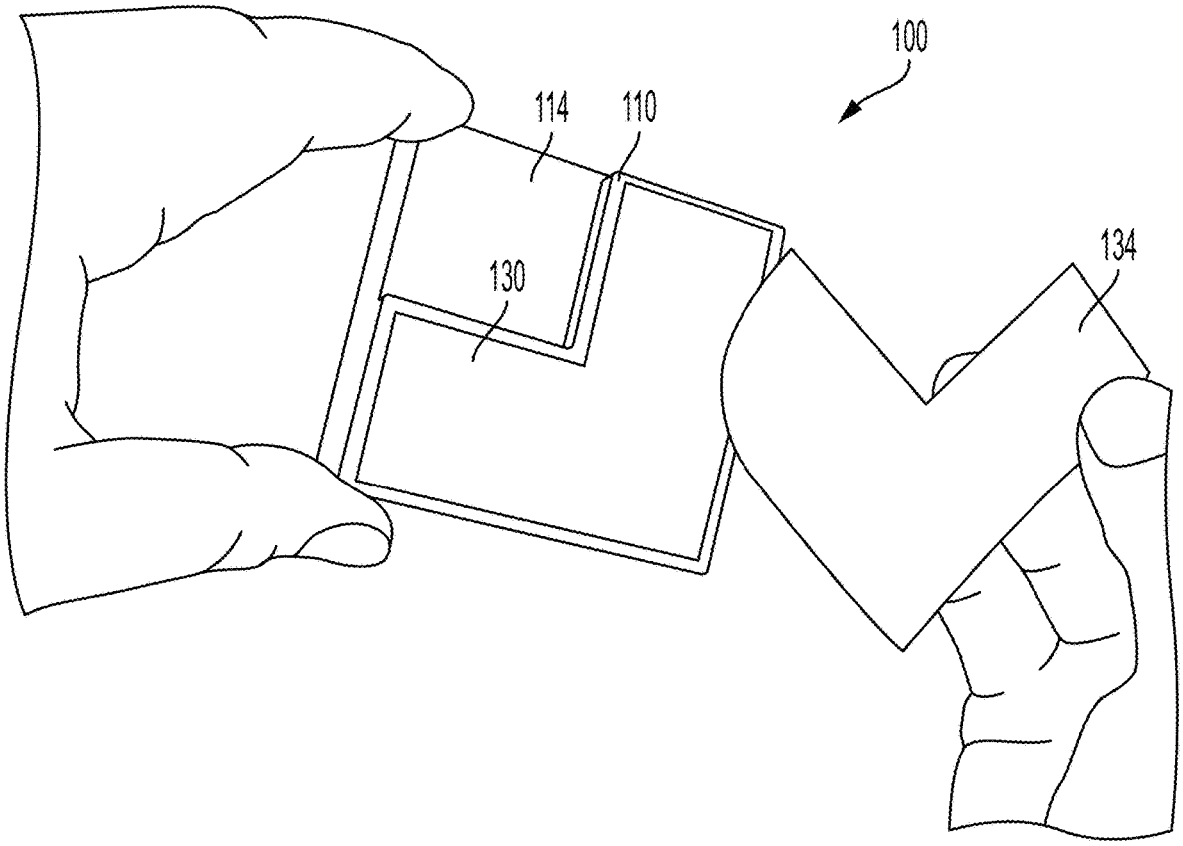
Figure 5D:
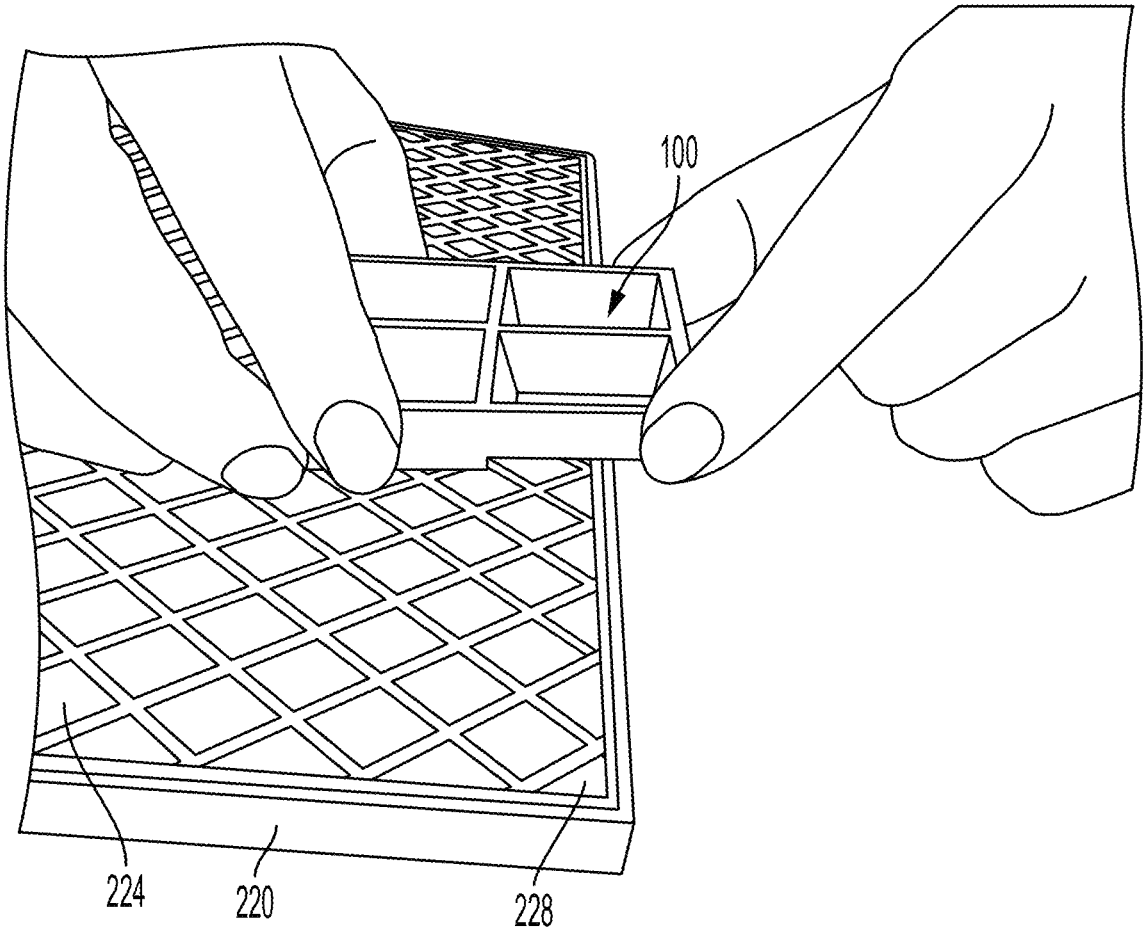
Figure 5E:
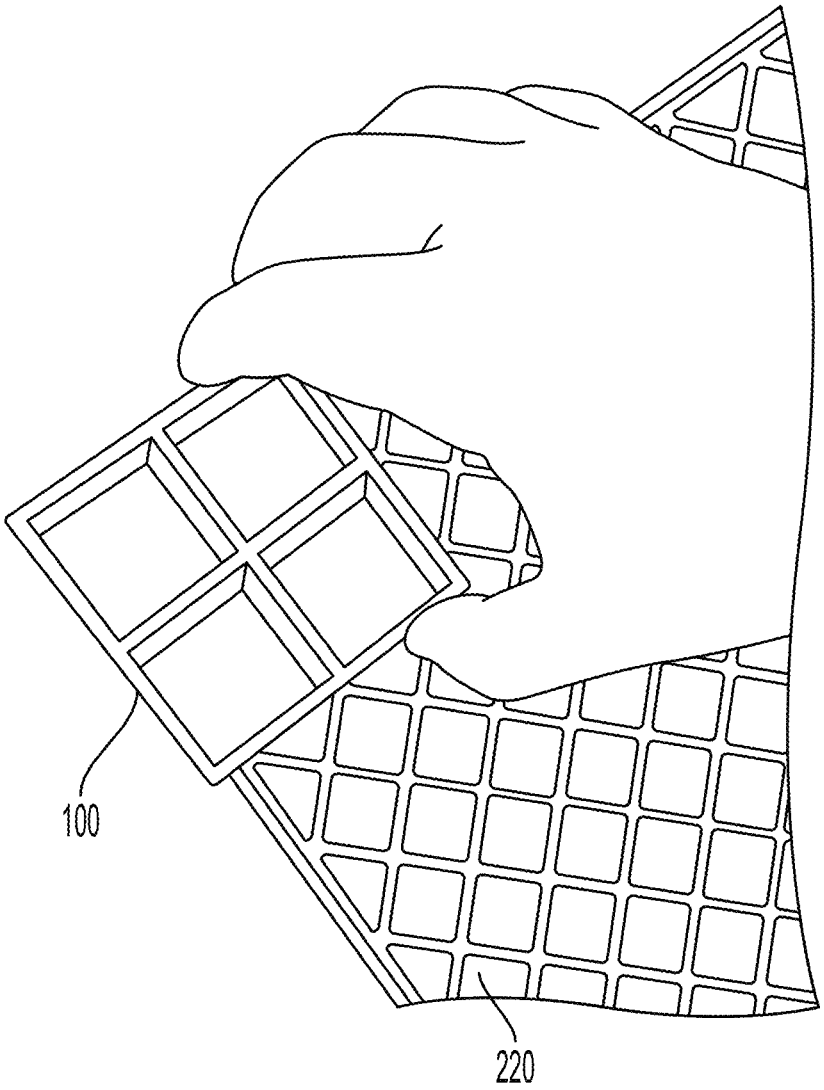
Figure 5F:
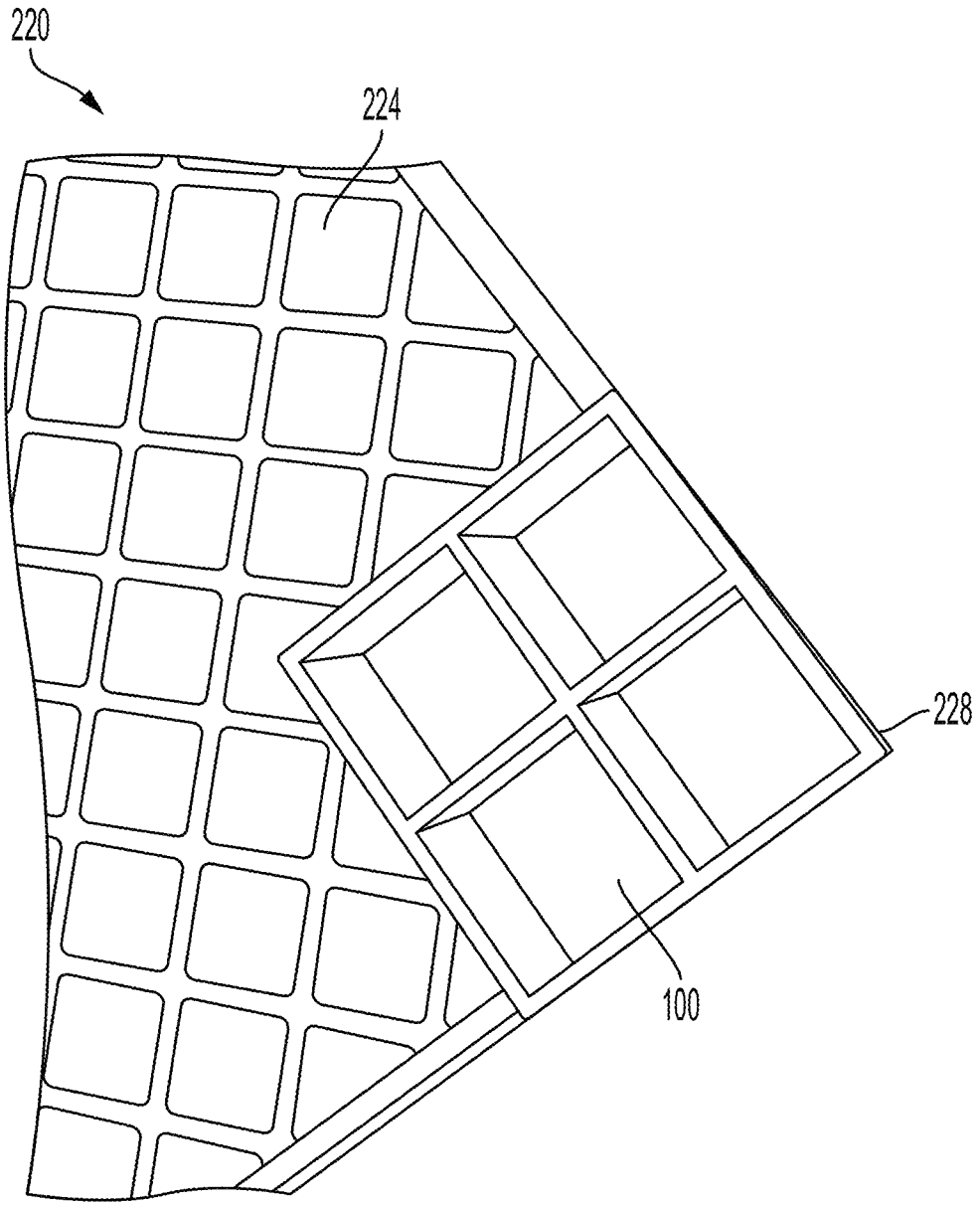
Figure 5G:
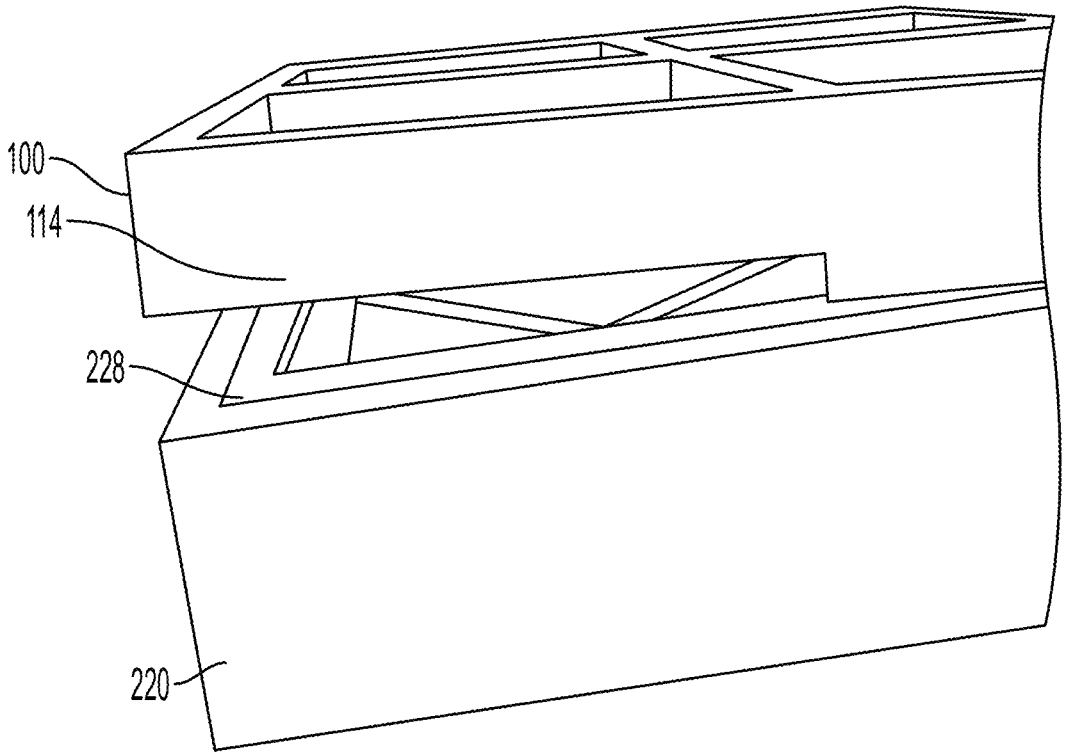

As best shown in FIGS. 1, 2 and 4, a two-sided adhesive strip 130 is securably attached to the upper surface 110 of the adaptive component 100. The adhesive strip 130 according to this exemplary embodiment is defined by a substantially L-shape that covers a majority of the upper surface 110 with the exception of a corner region 114 of the upper surface 110, the latter being recessed relative to the remainder of the upper surface 110. An inner side of the two-sided adhesive strip 130 is secured to the upper surface of the adaptive component 100, while an outer side of the adhesive strip 130 includes a removable backing strip 134 to enable attachment to a paver brick 220, FIG. 6, as described in greater detail below.

Figure 3:
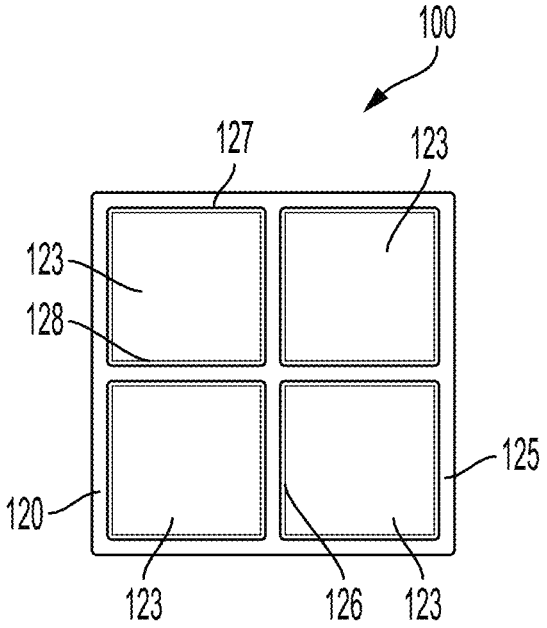
FIG. 3 is a bottom view of the adaptive component of FIGS. 1 and 2.

As best shown in FIG. 3, the lower surface 120 of the adaptive component 100 is defined by four (4) equal square compartments 123 that are bounded by outer walls 125, 127 and inner walls 126, 128, respectively. Each of the compartments 124 define an internal cavity 124, with the depth dimension of three of the cavities 124 of three (3) of the compartments 124 being larger than that of the fourth compartment due to the recessing of the upper surface 110 and as shown in FIGS. 3 and 4.

With reference to FIGS. 5(*a*)-5(*g*), sequential assembly views are shown of the adaptive component 100 of FIGS. 1-3 relative to a paver brick 220, the latter forming a part of a roofing or decking system. First, the adaptive component 100 is shown in FIG. 5(*a*) with the removable backing strip 134 still attached to the two-sided adhesive strip 130, which is attached as shown to the upper surface 110 of the adaptive component 100. In FIG. 5(*b*), the backing strip 134 is peeled or otherwise removed from the two-sided adhesive strip 130, leaving the adhesive exposed as shown in FIG. 5(*c*). In FIGS. 5(*d*) and 5(*e*), the upper surface 110 of the adaptive component 100 is subsequently attached to the lower facing side 224 of the paver brick 220 and secured via the two-sided adhesive strip 130. More specifically, the upper surface 110 of the adaptive component 100 is configured and sized to be attached and fitted to a corner 228 of the paver brick 224, as shown in FIGS. 5(*f*) and 5(*g*). More specifically, the adaptive component 100 is arranged with the recessed portion 114 being disposed directly on the corner 228 of the paver brick 220 and creating a substantial space or gap between the lower surface 224 of the paver brick 220 and the upper surface 110 of the adaptive component 100. This process is repeated for each of the remaining three corners of the paver brick 220 and subsequently for each paver brick 220 used in the decking or flooring/roofing system.

Figure 6:
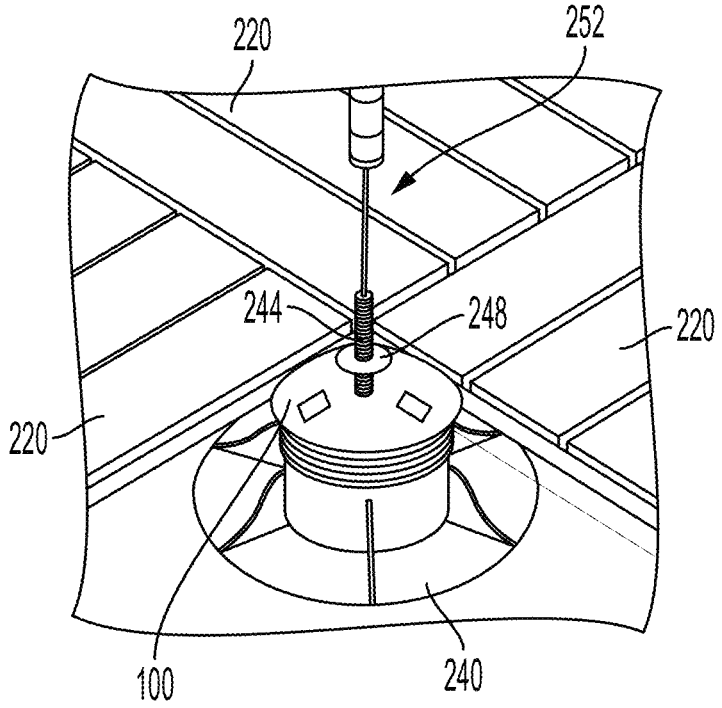
FIG. 6 is a top sectioned elevational view of a portion of a roofing or decking system configured with a plurality of adaptive components and in accordance with aspects of the present invention.

With reference to FIG. 6, a plurality of paver bricks 220 are shown in a later part of the assembly of the decking or roofing system, each of the paver bricks 220 being attached in an intersecting corner to an adaptive component 100 in similar fashion to that previously described in FIGS. 5(*a*)-5(*g*) and in relation to a pedestal 240 that is linked to four (4) of the intersecting paver bricks 220, only three being shown in FIG. 6 for reasons of clarity. The pedestal 240 is defined by a surface that enables the paver bricks 220 to be disposed and enabling adjustments to the paver bricks (height, etc.) using a center screw 244 and washer 248, accessed by a screw driver 252 in which the washer 248 is sized and configured to be fitted within the recessed corner portion 114 of the four (4) adaptive components 100. It is to be understood that FIG. 6 is illustrative of only a portion of the decking or roofing system that further includes an additional pedestals and paver bricks having the same relationship/configuration relative to additionally attached adaptive components 100, thereby creating a distributive network. As discussed, the adaptive components 100 advantageously create an air gap between the plurality of paver bricks 220 and the platform or support surface upon which the paver bricks 220 are disposed, thereby minimizing the effects of wind uplift on the roofing or decking system.

While the invention has been described in terms of particular variations and illustrative figures, those of ordinary skill in the art will recognize that the invention is not limited to the variations or figures described. In addition, where methods and steps described above indicate certain events occurring in certain order, those of ordinary skill in the art will recognize that the ordering of certain steps may be modified and that such modifications are in accordance with the variations of the invention. Additionally, certain of the steps may be performed concurrently in a parallel process when possible, as well as performed sequentially as described above. Therefore, to the extent there are variations of the invention, which are within the spirit of the disclosure or equivalent to the inventions found in the claims, it is the intent that this patent will cover those variations as well.

To the extent that the claims recite the phrase "at least one of" in reference to a plurality of elements, this is intended to mean at least one or more of the listed elements, and is not limited to at least one of each element. For example, "at least one of an element A, element B, and element C," is intended to indicate element A alone, or element B alone, or element C alone, or any combination thereof. "At least one of element A, element B, and element C" is not intended to be limited to at least one of an element A, at least one of an element B, and at least one of an element C.

The terminology used herein is for the purpose of describing particular embodiments only and is not intended to be limiting. As used herein, the singular forms "a," "an," and "the" are intended to include the plural forms as well, unless the context clearly indicates otherwise. It will be further understood that the terms "comprise" (and any form of comprise, such as "comprises" and "comprising"), "have" (and any form of have, such as "has" and "having"), "include" (and any form of include, such as "includes" and "including"), and "contain" (and any form of contain, such as "contains" and "containing") are open-ended linking verbs. As a result, a method or device that "comprises," "has," "includes," or "contains" one or more steps or elements possesses those one or more steps or elements, but is not limited to possessing only those one or more steps or elements. Likewise, a step of a method or an element of a device that "comprises," "has," "includes," or "contains" one or more features possesses those one or more features, but is not limited to possessing only those one or more features. Furthermore, a device or structure that is configured in a certain way is configured in at least that way, but may also be configured in ways that are not listed.

The corresponding structures, materials, acts, and equivalents of all means or step plus function elements in the claims below, if any, are intended to include any structure, material, or act for performing the function in combination with other claimed elements as specifically claimed. The description set forth herein has been presented for purposes of illustration and description, but is not intended to be exhaustive or limited to the form disclosed. Many modifications and variations will be apparent to those of ordinary skill in the art without departing from the scope and spirit of the disclosure. The embodiment was chosen and described in order to best explain the principles of one or more aspects set forth herein and the practical application, and to enable others of ordinary skill in the art to understand one or more aspects as described herein for various embodiments with various modifications as are suited to the particular use contemplated and in accordance with the following appended claims. Additional embodiments include any one of the embodiments described above and described in any and all exhibits and other materials submitted herewith, where one or more of its components, functionalities or structures is interchanged with, replaced by or augmented by one or more of the components, functionalities or structures of a different embodiment described above.

PARTS LIST FOR FIGS. 1-6

100 adaptive component
110 upper surface or side, adaptive component
114 recessed corner region, upper surface of adaptive component
120 bottom surface or side, adaptive component
123 compartments
124 cavities, compartments
125 outer wall
126 inner wall
127 outer wall
128 inner wall
130 two-sided adhesive strip
134 removable backing strip
220 paver brick
224 lower facing side, paver brick
228 corner, paver brick
240 pedestal
244 screw, center
248 washer
252 screw driver This detailed description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims. As noted, it will be understood that other suitable variations and modifications will be readily apparent and understood by those of sufficient skill in the field reading the preceding detailed description and as will further be understood from the following listed claims.

The invention claimed is:

1. A roofing or decking system comprising:
a plurality of paver bricks, each of the paver bricks having an inner facing surface and an outer facing surface;
a platform onto which the plurality of paver bricks are disposed in side by side relation; and
a plurality of adaptive components attached to respective corner portions of the inner facing surfaces of adjacent said paver bricks to distribute wind uplift forces, the plurality of adaptive components each comprise an upper surface and an opposing lower surface and include an L-shaped connecting element attached to the upper surface for attaching the adaptive components to the paver bricks, the plurality of adaptive components defining an air gap between the plurality of paver bricks and the platform.

2. The roofing or decking system of claim 1, in which the L-shaped connecting element is a two-sided adhesive strip attached to the upper surface.

3. The roofing or decking system of claim 2, wherein a corner portion of the upper surface of each of the plurality of adaptive components is recessed.

4. The roofing or decking system of claim 2, wherein the lower surface of the adhesive components includes a plurality of compartments, each compartment being defined by an open-ended cavity.

5. The roofing or decking system of claim 3, further comprising a plurality of pedestals disposed on the platform between one or more of the paver bricks and wherein the recessed portion of the adaptive components of a number of intersecting said paver bricks is sized to accommodate a center screw and washer of one of the pedestals to enable adjustment.

6. A method for minimizing uplift created by wind force on a roofing or decking system, the method comprising:
providing a plurality of paver bricks onto a platform or support surface;
attaching an adaptive component having an upper surface and an opposing lower surface to a respective corner of each paver brick on an inner facing surface thereof by way of an L-shaped connecting element attached to the upper surface of the adaptive components;
disposing the paver bricks on the platform or support surface, wherein the adaptive components define an air gap between the paver bricks and the platform or support surface in order to minimize wind uplift forces.

7. The method of claim 6, in which the L-shaped connecting element is a two-sided adhesive strip attached to the upper surface, in which the adhesive strip is used for attaching the adhesive component(s) to the paver bricks.

8. The method of claim 7, wherein a portion of the upper surface of each adaptive component is recessed and in which the two-sided adhesive strip does not cover the recessed portion.

9. The method of claim 8, further comprising disposing a plurality of pedestals in which a respective said pedestal is disposed between a number of intersecting said paving bricks onto the platform or support surface, wherein the recessed portions of the adaptive components create a corner gap that permits the passage of a center screw and washer of the pedestal to enable adjustment.

10. The method of claim 9, wherein the number of intersecting paving bricks is four.

* * * * *